US009783399B2

(12) United States Patent
Hausladen et al.

(10) Patent No.: US 9,783,399 B2
(45) Date of Patent: Oct. 10, 2017

(54) ROPE WINCH

(71) Applicant: LIEBHERR COMPONENTS BIBERACH GMBH, Biberach an der Riss (DE)

(72) Inventors: Norbert Hausladen, Biberach (DE); Gerd Hepp, Unterstadion (DE)

(73) Assignee: LIEBHERR COMPONENTS BIBERACH GMBH, Biberach an der Riss (DE)

( * ) Notice: Subject to any disclaimer, the term of this patent is extended or adjusted under 35 U.S.C. 154(b) by 55 days.

(21) Appl. No.: 14/374,823

(22) PCT Filed: Nov. 22, 2012

(86) PCT No.: PCT/EP2012/004834
§ 371 (c)(1),
(2) Date: Jul. 25, 2014

(87) PCT Pub. No.: WO2013/110300
PCT Pub. Date: Aug. 1, 2013

(65) Prior Publication Data

US 2015/0008381 A1 Jan. 8, 2015

(30) Foreign Application Priority Data

Jan. 27, 2012 (DE) ..... 10 2012 001 592

(51) Int. Cl.
*B66D 1/39* (2006.01)
*B66D 1/30* (2006.01)
(Continued)

(52) U.S. Cl.
CPC ..... *B66D 1/39* (2013.01); *B66D 1/26* (2013.01); *B66D 1/30* (2013.01); *B66D 1/365* (2013.01); *B66D 1/38* (2013.01)

(58) Field of Classification Search
CPC . B66D 1/26; B66D 1/30; B66D 1/365; B66D 1/38; B66D 1/39; B66D 1/36
(Continued)

(56) References Cited

U.S. PATENT DOCUMENTS 247,169 A * 9/1881 Coker ..... F16D 41/22 192/31
2,959,396 A * 11/1960 Lawrence ..... B60P 3/14 254/273
(Continued)

FOREIGN PATENT DOCUMENTS

AT 11 687 U1 3/2011
CN 1277300 A 12/2000
(Continued)

OTHER PUBLICATIONS

International Search Report dated May 2, 2013 issued in corresponding application No. PCT/EP2012/004834.
(Continued)

*Primary Examiner* — Emmanuel M Marcelo
*Assistant Examiner* — Michael Gallion
(74) *Attorney, Agent, or Firm* — Westerman, Hattori, Daniels & Adrian, LLP

(57) ABSTRACT

The present invention relates to a hoisting winch, in particular to a hoisting gear winch, having a hoisting drum whose winding region is bounded by two lateral flanged wheels, wherein at least one further flanged wheel is provided between the lateral flanged wheels for dividing the winding region into at least two part winding regions, wherein the cable can be guided beyond the named further flanged wheel into the at least two part winding regions. It is suggested in accordance with the invention to move the hoisting drum and/or a transverse cable guide arranged in front of the hoisting drum transversely to the longitudinal
(Continued)

direction of the running in/running off cable approximately in the longitudinal direction of the drum and/or to adjust the angular position of the hoisting drum transversely to the longitudinal direction of the drum with respect to at least one transverse axis.

21 Claims, 12 Drawing Sheets

(51) Int. Cl.
*B66D 1/36* (2006.01)
*B66D 1/38* (2006.01)
*B66D 1/26* (2006.01)

(58) Field of Classification Search
USPC ..... 254/278; 242/530.1, 530.4, 531, 594.2, 242/594.3, 594.5, 594.6
See application file for complete search history.

(56) References Cited

U.S. PATENT DOCUMENTS 3,456,899 A * 7/1969 Burch ..... B66D 1/39 242/484
3,524,606 A * 8/1970 Coski ..... B65H 75/4402 242/484
3,536,298 A * 10/1970 Deslierres ..... B63B 21/663 114/244
3,641,835 A * 2/1972 Tornheim ..... B60P 1/14 74/501.5 R
3,675,786 A * 7/1972 Wilson ..... B66C 13/54 212/291
3,690,409 A * 9/1972 Brauss ..... B66D 1/14 182/142
3,809,334 A * 5/1974 Beurer ..... B64D 1/22 242/390.2
3,874,514 A * 4/1975 Wilson ..... B66C 17/10 212/290
3,912,229 A * 10/1975 Mitchell ..... B66D 1/26 254/295
4,002,321 A * 1/1977 Shaw ..... B66D 1/365 212/97
4,204,354 A * 5/1980 Kane ..... A01K 73/06 254/332
4,244,561 A * 1/1981 Campbell ..... B66D 1/26 242/157 R
4,349,180 A * 9/1982 Charles ..... B63G 8/42 114/254
4,520,999 A * 6/1985 Philips ..... B66D 1/34 254/266
4,650,163 A * 3/1987 Peterson ..... B66D 1/00 254/327
4,778,121 A * 10/1988 Minnee ..... B66D 1/38 242/157.1
5,215,272 A * 6/1993 Sauber ..... B65H 54/02 242/364
5,215,278 A * 6/1993 Hess ..... A01B 45/04 172/20
5,330,122 A * 7/1994 Wood ..... B66D 1/38 242/397.3
5,564,637 A * 10/1996 Berthold ..... B65H 54/2803 242/157.1
5,636,648 A * 6/1997 O'Brien ..... B08B 9/04 134/107
5,803,278 A * 9/1998 Shiwaku ..... B61B 3/02 212/274
5,982,590 A * 11/1999 Kinjo ..... G11B 5/53 360/130.24
6,276,503 B1 * 8/2001 Laughlin, Jr. ..... B65H 75/403 191/12.2 A
6,523,806 B2 * 2/2003 Bartal ..... B66D 1/365 254/272
6,811,112 B1 * 11/2004 Currie ..... B65H 54/2872 242/157.1
7,080,826 B2 * 7/2006 Pockl ..... B66D 1/365 254/332
8,616,529 B2 * 12/2013 Kim ..... B66D 1/39 254/335
8,657,261 B2 * 2/2014 Mehrkens ..... A63C 11/10 254/323
8,820,718 B2 * 9/2014 Weidner ..... B66D 1/00 254/329
9,038,990 B2 * 5/2015 Krappinger ..... B66D 1/39 254/331
2003/0111651 A1 * 6/2003 Volle ..... B66C 17/00 254/278
2004/0065767 A1 * 4/2004 Parker ..... A01K 3/00 242/557
2005/0056819 A1 * 3/2005 Pockl ..... B66D 1/365 254/277
2009/0134373 A1 * 5/2009 Arzberger ..... B66D 1/365 254/361
2013/0170939 A1 * 7/2013 Roodenburg ..... B66D 1/7405 414/800
2013/0193689 A1 * 8/2013 Grassi ..... B66D 1/7405 290/53
2014/0166953 A1 * 6/2014 Wright ..... B66D 1/485 254/270

FOREIGN PATENT DOCUMENTS

| | | | |
|---|---|---|---|
| CN | 2806416 | Y | 8/2006 |
| CN | 101445210 | A | 6/2009 |
| CN | 201447325 | U | 5/2010 |
| CN | 102285603 | A | 12/2011 |
| DE | 1 969 245 | | 9/1967 |
| DE | 3511655 | A1 | 10/1986 |
| DE | 256 500 | A1 | 5/1988 |
| DE | 20 2005 011 277 | U1 | 12/2006 |
| EP | 0043367 | A2 | 1/1982 |
| EP | 2 028 153 | A1 | 2/2009 |
| FR | 2278619 | A1 | 2/1976 |
| GB | 2 296 001 | A | 6/1996 |
| JP | 58-48693 | U | 4/1983 |
| JP | 62-114420 | A | 5/1987 |
| JP | 3-42467 | A | 2/1991 |
| JP | 3-33892 | U | 4/1991 |
| JP | 7-187583 | A | 7/1995 |
| JP | 2001-2379 | A | 1/2001 |
| JP | 2003-129656 | A | 5/2003 |
| WO | 98/18566 | | 6/1996 |

OTHER PUBLICATIONS

PCT/ISA/206 dated Feb. 5, 2013 issued in corresponding application No. PCT/EP2012/004834.
Written Opinion of the International Searching Authority dated Feb. 5, 2013 issued in corresponding application No. PCT/EP2012/004834.
Search Report dated Oct. 22, 2015, issued in counterpart Germany Application No. 10 2012 001 592.5 (4 pages).
Office Action dated Sep. 8, 2015, issued in counterpart Chinese Application No. 201280068284.7, with English Translation. (20 pages).

* cited by examiner

ROPE WINCH

BACKGROUND OF THE INVENTION

The present invention relates to a hoisting winch, in particular to a hoisting gear winch, having a hoisting drum whose winding region is bounded by two lateral flanged wheels, wherein at least one further flanged wheel is provided between the lateral flanged wheels for dividing the winding region into at least two part winding regions, wherein the cable can be guided beyond the named further flanged wheel into the at least two part winding regions.

Winding problems typically occur in hoisting winches when the hoisting drum has a very large number of turns next to one another and the cable is to be wound in a plurality of layers over one another. The problem is in particular intensified in this respect when the cable is to be wound up without any or with only a little cable preload. If higher cable tension forces abruptly act on a more or less loosely wound cable package such as can occur, for example, during demolition work or dismantling work, the loose winding package can be displaced, with the cable tending to cut in between winding layers disposed thereunder. This problem also occurs in an intensified manner in applications in the deep-sea sector since here cable lengths often have to be wound up and unwound over several thousand meters. A cable which has been severely cut in results in the worst case in the destruction of the cable so that it has to be replaced. There is furthermore the risk that the hoisting procedure can no longer be completed and complex auxiliary measures have to be initiated.

The background of this possible cutting in of a cable between cable layers disposed thereunder is in this respect also the fact that thickness tolerances of the cable to be wound up have to be considered for the windings of the cable on the hoisting drum. The pitch on the hoisting drum has to be matched to the possible cable tolerances, with a certain play being necessary between the cable to be wound up and the winch pitch so that the cable sections have room next to one another on winding up, with this play being decisively influenced by the cable thickness tolerance, the hoisting winch pitch tolerance and the nominal play. With commercial cables, the tolerance of the cable diameter amounts to approximately 2-4% of the nominal diameter so that the pitch on the hoisting drum has to consider approximately 5% of the nominal diameter of the cable. Tighter tolerance widths are admittedly offered on the market, but are expensive and are not available everywhere. Accordingly, the cable gap between the windings can vary in dependence on the tolerance of the cable diameter, with the cable gaps adding up over the windings so that it can occur with the aforesaid tolerance ranges and the cable thicknesses customary for hoisting gear with a winding number of around 40 that the maximum added up gap dimension may exceed the cable thickness. Accordingly, it can occur due to a cable tightly tensioned in the next winding layer that the layers disposed thereunder are displaced or the named cable can cut into between two winding sections disposed thereunder.

Furthermore, the named winding problems are also influenced by the run-off angle or the run-in angle of the cable with respect to the longitudinal drum axis. The more slanted the cable is on running off the hoisting winch or on running onto the hoisting winch, the greater the tendency to transverse displacements and winding problems.

To avoid the named problems or to alleviate this problem, a hoisting drum having a very large drum diameter is typically selected for very large cable lengths in order nevertheless to be able to wind up and unwind large cable lengths with a limited number of windings next to one another. However, this produces hoisting drums which are heavy in construction and relatively expensive in manufacture. In addition, with large drum diameters, high torques necessarily arise in the winch transmission due to the cable tension and the drum radius as well as the lever arm derived therefrom which result in corresponding loads and wear.

Document DE 20 2005 011 277 U1 proposes a hoisting winch of the initially named kind in which the winding region is divided into a plurality of part winding regions in which the cable is successively wound up. A further flanged wheel which divides the winding region into two part winding regions is arranged approximately centrally between the lateral flanged wheels which bound the total winding region in a manner known per se. The cable can be led beyond the flanged wheel via a spiral cable guiding channel at the said further flanged wheel to wind up the cable in the second part winding region after winding the first part winding region.

SUMMARY OF THE INVENTION

The previously explained winding problems can be considerably reduced by such a division of the winding region of the hoisting drum. However, the cable lengths which can be wound up are ultimately also limited here since with correspondingly higher cable lengths a larger number of divisions would have to be carried out, which would in turn, however, result in drum lengths and drum widths which are too large in which the run-in angle of the cable, which becomes more and more oblique in the lateral part winding regions toward the end-side face of the hoisting drum, would result in transverse forces on the cable winding which are larger and larger.

It is the underlying object of the present invention to provide an improved hoisting winch of the initially named kind which avoids disadvantages of the prior art and further develops the latter in an advantageous manner. Winding problems such as the cutting in of the cable between winding sections disposed thereunder should in particular also be reliably avoided with very large cable lengths of up to several thousand meters even with a lack or with only a small cable preload or with a highly varying cable tension, without this being acquired at the cost of excessive drum diameters, a high winch weight and high torques resulting therefrom.

This object is achieved in accordance with the invention by a hoisting winch as disclosed. Preferred embodiments of the invention are also disclosed.

It is proposed, in addition to the division of the winding region into a plurality of part winding regions, to move the hoisting drum and/or a transverse cable guide arranged in front of the hoisting drum approximately in the longitudinal direction of the drum transversely to the longitudinal direction of the cable running in/running off and/or to adjust the hoisting drum in its angular position with respect to at least one transverse axis transversely to the longitudinal direction of the drum to keep the angle of inclination of the cable running in/running off in the different part angle regions small. The axial position and/or angular position of the hoisting drum and/or the axial position of the transverse cable guide in front of the hoisting drum is matched to the part winding region to be wound/unwound.

In accordance with a first aspect of the present invention, the hoisting drum is axially adjustable in the longitudinal direction of the drum, with a cable run-in control apparatus being provided for setting at least two different axial positions of the hoisting drum for the winding/unwinding of the at least two different part winding regions of the hoisting drum. If the cable is wound up/unwound at the one side of the dividing flanged wheel, the hoisting drum is moved in a different axial position than if the cable is wound up/unwound on the other side of the named dividing flanged wheel.

Alternatively or additionally to an axial adjustment of the hoisting drum, a cable run-in guide which can be provided for guiding the cable running in/running off in front of the hoisting drum can be adjusted axially in the longitudinal direction of the drum relative to the hoisting drum to guide the cable section running in/running off in different axial positions when the cable is wound up/unwound in different part winding regions of the hoisting drum.

The axial adjustability of the hoisting drum and/or of the cable run-in guide in the longitudinal direction of the drum can take place in this respect more or less exactly parallel to the axis of rotation of the drum, with an adjustment path inclined more or less toward the axis of rotation of the drum, however, also being able to be provided in an alternative further development of the invention as long as the adjustment movement has a component in the longitudinal direction of the drum. In an advantageous further development of the invention, the named adjustment path is in this respect straight or linear and is aligned substantially parallel to the axis of rotation of the drum so as not to have any unwanted effects on the cable length on a transverse adjustment or so as not to have to compensate them in a complex and/or expensive manner.

Alternatively or additionally to such an axial adjustment, the hoisting drum can be configured tiltable and/or pivotable about at least one transverse axis transversely to the longitudinal direction of the drum to bring the hoisting drum into different tilt positions and/or pivot positions when the cable is wound up/unwound in different part winding regions of the hoisting drum. A drift of the cable which would otherwise arise with different cable run-in directions or on the winding of different part winding regions of the hoisting drum can be compensated or reduced by tilting or pivoting the hoisting drum. At the same time, the space requirements for the adjustment of the winch can be minimized since a tilting or pivoting can be carried out in a very small space. If the cable is wound up/unwound on the one side of the dividing flanged wheel, the hoisting drum is tilted or pivoted into a different angular position than if the cable is wound up/unwound on the other side of the named dividing flanged wheel.

The hoisting drum can in this respect preferably be tilted and pivoted biaxially about differently orientated transverse axes to be able to compensate or reduce a drift of the cable for different cable running directions. The hoisting drum can in particular be tiltable about a tilt axis and pivotable about a pivot axis, with the tilt axis and the pivot axis being orientated at least approximately perpendicular relative to one another and each extending at least approximately perpendicular to the longitudinal direction of the drum. The tilt axis and the pivot axis do not have to intersect one another in this respect, but can be arranged at different, preferably parallel, planes with an approximately right-angled or transversely running orientation, also offset from one another, depending on how the tiltability and the pivotability are realized. A multiaxial tiltability or pivotability of the hoisting drum is in particular of advantage when the cable run-in/run-off does not only vary transversely to the hoisting drum, but also with respect to the peripheral angle, i.e. the run-in point of the cable at the hoisting drum can be disposed in different angular sectors, such as is the case, for example, when a crane boom on which the run-in roller is fastened moves relative to the winch, in particular luffs up and down. A drift of the cable with respect to the hoisting drum can be compensated or reduced by a multiaxial tiltability or pivotability of the hoisting drum irrespective of the peripheral region in which the cable runs onto the drum.

In a further development of the invention, the winding region of the hoisting drum cannot only be divided into two part winding regions, but also into three or four or also any desired number of part winding regions by an axial adjustment and/or angular adjustment of the hoisting drum and/or of the cable run-in guide in the longitudinal direction of the drum so that the hoisting winch is put into a position to be able to wind up and unwind any desired length of cables and in so doing simultaneously observe the desired winding parameters. In particular with a displaceability of the hoisting winch itself, only the hoisting winch has to be correspondingly further displaced in accordance with the pitch of the winding region when a part winding region is completely wound or unwound without in this respect other geometrical parameters of the running off or running in cable having to be modified or an unwanted transverse strain arising on the cable.

The adjustability of the hoisting drum transversely to the longitudinal direction of the cable can generally be realized in any manner. The hoisting drum could, for example, be adjustable in the desired direction via a rod guide or the like. However, in an advantageous further development of the invention, the hoisting drum is supported at oppositely disposed end sections by a respective bearing slide, with the bearing slides being displaceably supported essentially parallel to the longitudinal direction of the drum. A slide guide of the hoisting drum allows a simple movement with a simultaneously stable elimination of also high bearing forces.

The named bearing slide parts at the end side could generally be connected to one another and form part of a common pushing slide which is displaceable in the desired manner in a slide guide. However, in an advantageous further development of the invention, the bearing slides which are provided at the oppositely disposed end sections of the hoisting drum can be displaceable independently of one another or can be held relative to one another only by the hoisting drum in the axial direction. The hoisting drum can be supported and adjusted without strain in the manner of a fixed-movable bearing by such an independent design of the bearing slides at oppositely disposed ends. A tensioning of the winch plates due to the influence of heat, component tolerances and deformation due to hoisting winch forces are hereby prevented. In this respect, the lateral bearing slide parts can by all means be displaceably supported on a common, optionally throughgoing, slide guide. Alternatively, however, slide guide sections can also be provided which are separate from one another so that each of the named lateral bearing slide parts is displaceably held at its own slide guide.

In a further development of the invention for the adjustment of the hoisting drum, an actuating drive is provided which can be connected to one of the named bearing slide parts to be able to move the hoisting drum to and fro in the longitudinal direction of the drum. The named actuating drive can in this respect have a different design in principle, for example have a pressure medium cylinder or can also comprise other adjustment actuators such as a spindle drive.

The adjustability of the angular alignment of the hoisting drum can generally be realized in different manners. For example, the bearing plates or the bearing slides between which the hoisting drum is arranged and at which the oppositely disposed end sections of the hoisting drum are rotatably supported can be tiltably supported about a tilt axis and/or can be pivotably supported about a pivot axis so that a tilting or a pivoting of the hoisting drum can be effected by a corresponding adjustment of the bearing plates or bearing slides. In this respect, simple pivot bearings can be provided between the bearing plates and the ends of the hoisting drum. The bearing plates can in this respect be connected to one another and can, for example, form an approximately U-shaped bearing block which is tiltably or pivotably supported.

Alternatively or additionally to a tiltable and/or pivotable support of the bearing plates, the desired tilting and/or pivoting of the hoisting drum can be achieved by a corresponding movement of the hoisting drum relative to the bearing plates. For this purpose, for example, one of the end sections of the hoisting winch can be supported not only rotatable at the corresponding bearing plate or bearing slide, but can also be supported in a in oscillating or tiltable manner, for example by a corresponding pendulum bearing. The oppositely disposed end section of the hoisting drum can be adjusted transversely to the longitudinal direction of the drum with respect to the bearing plate or bearing slide provided there by at least one suitable actuating drive so that the desired tilt or pivot movement of the hoisting drum takes place. In this respect, for example, adjustment actuators in the form of servo control cylinders can be used. Alternatively or additionally, a support can also be provided by means of an eccentric tappet which can be integrated into the corresponding bearing plate or bearing slide such that a rotation of the eccentric tappet results in an adjustment of the corresponding hoisting drum end transversely to the longitudinal direction of the drum.

If the run-in angle/run-off angle of the running in/running off cable is controlled by a transversely adjustable cable run-in guide for the winding/unwinding of the different part winding regions, such a cable run-in guide can generally be of different design. In a further development of the invention, the named cable running guide can comprise a cable deflection roller which is axially adjustable in the longitudinal direction of the drum. The cable deflection roller is adjusted relative to the hoisting drum in dependence on which part winding region is to be wound/unwound.

Alternatively or additionally to such an axially adjustable cable deflection roller, the cable run-in guide can also comprise other axially adjustable transverse cable guiding means which can advantageously be arranged between the named cable deflection roller and the hoisting drum. In this case, the named cable deflection roller can advantageously be supported in an oscillating manner, in particular when this cable deflection roller is axially fixed, such that the named cable deflection roller orientates itself with respect to the transverse cable guide means. The cable deflection roller can in particular be supported in a pivotable or gimbaled manner at the run-in/run-off of the cable so that the cable deflection roller can follow the slanted pull which arises due to the movement of the named transverse cable guide means and less wear arises on the cable roller flanks.

The axial adjustment of the hoisting winch and/or of the cable run-in guide can generally be matched in different ways to the winding/unwinding of the different part winding regions or can be controlled in dependence hereon. In accordance with an advantageous further development of the invention, the axial adjustment of the hoisting winch and/or of the cable run-in guide can take place continuously or approximately continuously, i.e. incrementally in small stages, and indeed advantageously in dependence on the drum rotation and winch pitch. The named axial adjustment can in this respect actually be carried out continuously, with the speed of the axial displacement being matched to the rotational speed of the drum and to the winch pitch so that the cable always runs or is guided exactly in front of the respective winding section to be wound/unwound. Alternatively, such a continuous axial adjustment can also be approximated incrementally or stepwise, for example such that, for example, the hoisting drum and/or the cable run-in guide is moved axially a little further after each full revolution of the hoisting drum or on each second revolution, a rotation by 720°.

Provision can, however, alternatively also be made that only an axial position or optionally a limited number of axial positions of the hoisting drum and/or of the cable run-in guide is set for each part winding region, for example such that the hoisting drum and/or the cable run-in guide is moved on the passing over of the part winding region border, i.e. of the dividing flanged wheel, into a new axial position which is provided for the winding/unwinding of the new or next part winding region.

If more than only one axial position is provided for a part winding region, for example with a continuous or stepwise axial adjustment in dependence on the drum rotation and the winch pitch, the side run-in control apparatus can provide different axial adjustment regions for the different part winding regions, with the different axial adjustment position being able to have different designs from one another for the axial adjustment of the hoisting drum and/or of the cable run-in guide and can in particular be free of overlap. The hoisting drum and/or the cable run-in guide can be brought into axial positions for the winding/unwinding of a first part winding region which differ from the axial positions into which the hoisting drum and/or the cable run-in guide are brought when a different part winding region is wound or unwound.

In an advantageous further development of the invention, a detection device can be provided for detecting the cable run-in angle, with the cable run-in control apparatus controlling the hoisting drum and/or the cable run-in guide in dependence on a signal of the named detection device.

In an advantageous further development of the invention, the named detection device and/or a further detection device can detect the position of the cable relative to the hoisting drum, in particular a position which indicates a moving or running over the part winding region border and/or of the dividing interposed flanged wheel. Such a detection device can, for example, be a transmission cam limit switch, but can also have a different design. If a moving over of the dividing flanged wheel or of the part winding region border is detected, the control apparatus of the hoisting winch can reduce, in an advantageous further development of the invention, the speed of the hoisting drum to a predefined value to achieve the transition from a part winding region into another part winding region without any real cable wear.

In a further development of the invention, the hoisting winch can have a further hoisting drum which can serve as an auxiliary winch beside the named hoisting drum divided into different part winding regions. In an advantageous further development of the invention, the second hoisting drum can be placed onto the first hoisting drum and/or can be axially displaceably supported together with the first hoisting drum. Alternatively or additionally, the second, additional hoisting drum can be configured as axially adjustable relative to the aforesaid first hoisting drum.

BRIEF DESCRIPTION OF THE DRAWINGS

The present invention will be explained in more detail in the following with respect to preferred embodiments and to associated drawings. There are shown in the drawings.

DETAILED DESCRIPTION OF THE INVENTION

Figure 1:
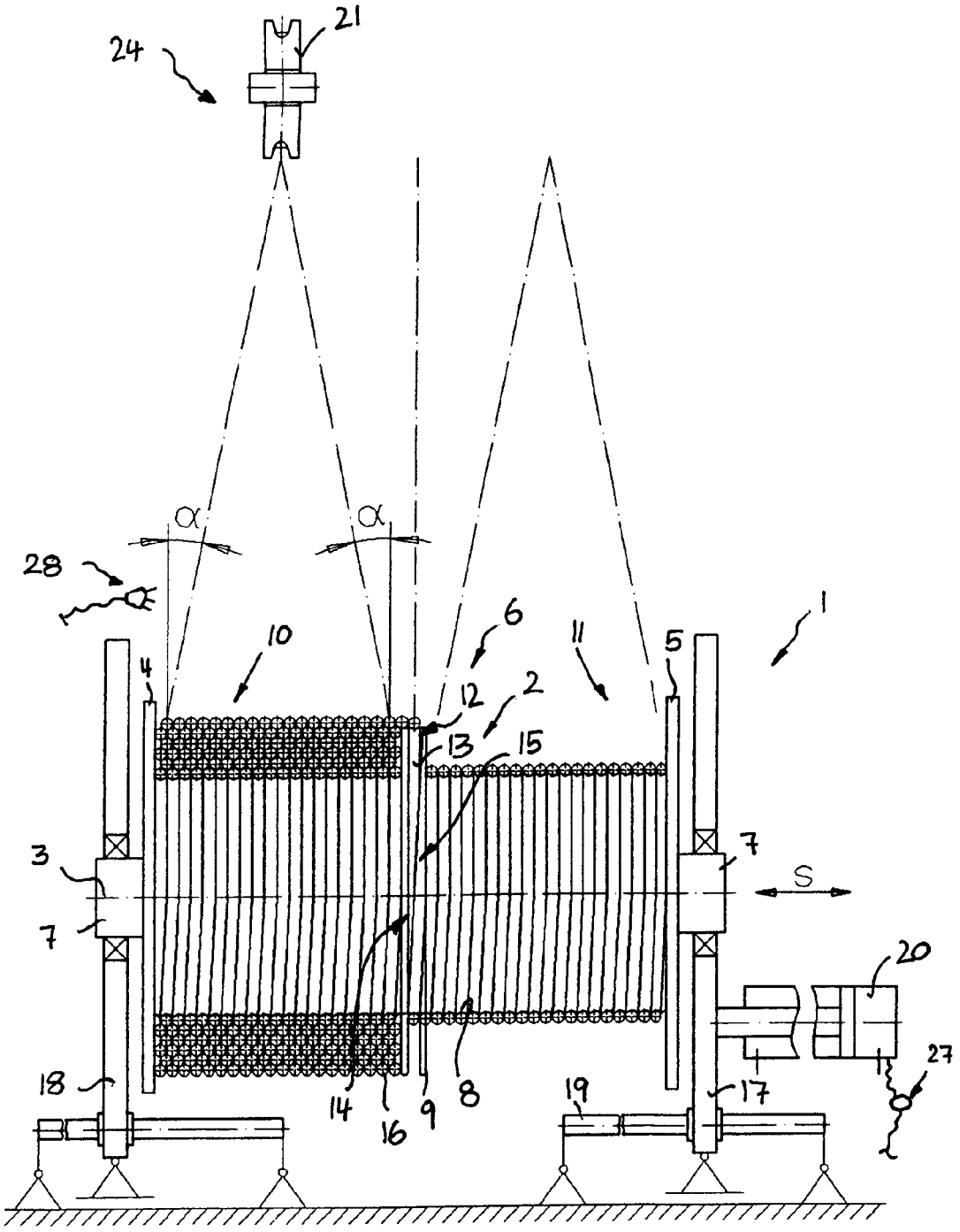
FIG. 1 a plan view of a hoisting winch of a hoisting gear in accordance with an advantageous embodiment of the invention, with the hoisting drum being divided into two part winding regions and with the winding of both part regions being shown schematically, with the hoisting drum being configured as axially displaceable via a slide.

The hoisting winch 1 shown in the Figures comprises a substantially cylindrical hoisting drum 2 at whose end faces two flanged wheels 4 and 5 are provided which extend radially to the axis of rotation 3 of the hoisting drum and between which the winding region 6 of the hoisting drum 2 is defined. In a manner known per se, bearing and/or drive stubs 7 in the form of axially projecting shaft stumps can be provided at the hoisting drum 2 and the hoisting winch 1 can be installed with them in the hoisting gear of a crane or the like and can be longitudinally supported as will be explained below.

The jacket surface of the hoisting drum 2 is, as FIG. 1 shows, provided with cable grooves 8 which extend spirally in the manner of a thread on the outer side of the hoisting drum 2 to guide the cable to be wound up, more precisely the first cable layer, on the hoisting drum 2.

As FIG. 1 shows, the winding region 6 of the hoisting drum 2 is divided into two part winding regions 10 and 11 by a further flanged wheel 9 which is seated between the two end-face flanged wheels 4 and 5 on the hoisting drum 2 and likewise extends radially. In the drawn embodiment, the additional flanged wheel 9 is drawn between the two end-face flanged wheels 4 and 5; however, depending on the relationships in the typical cable winding, it can also be displaced toward the one or the other flanged wheel 4 or 5. It is furthermore stated that the winding region 6 of the hoisting drum 2 can be divided into more than two part winding regions by a plurality of additional flanged wheels 9. In the typical applications of a crane hoisting gear, the problem of the hoisting cable being clamped between the winding layers can, however, already be effectively suppressed by an additional flanged wheel so that an additional flanged wheel 9 is already sufficient.

Figure 2:
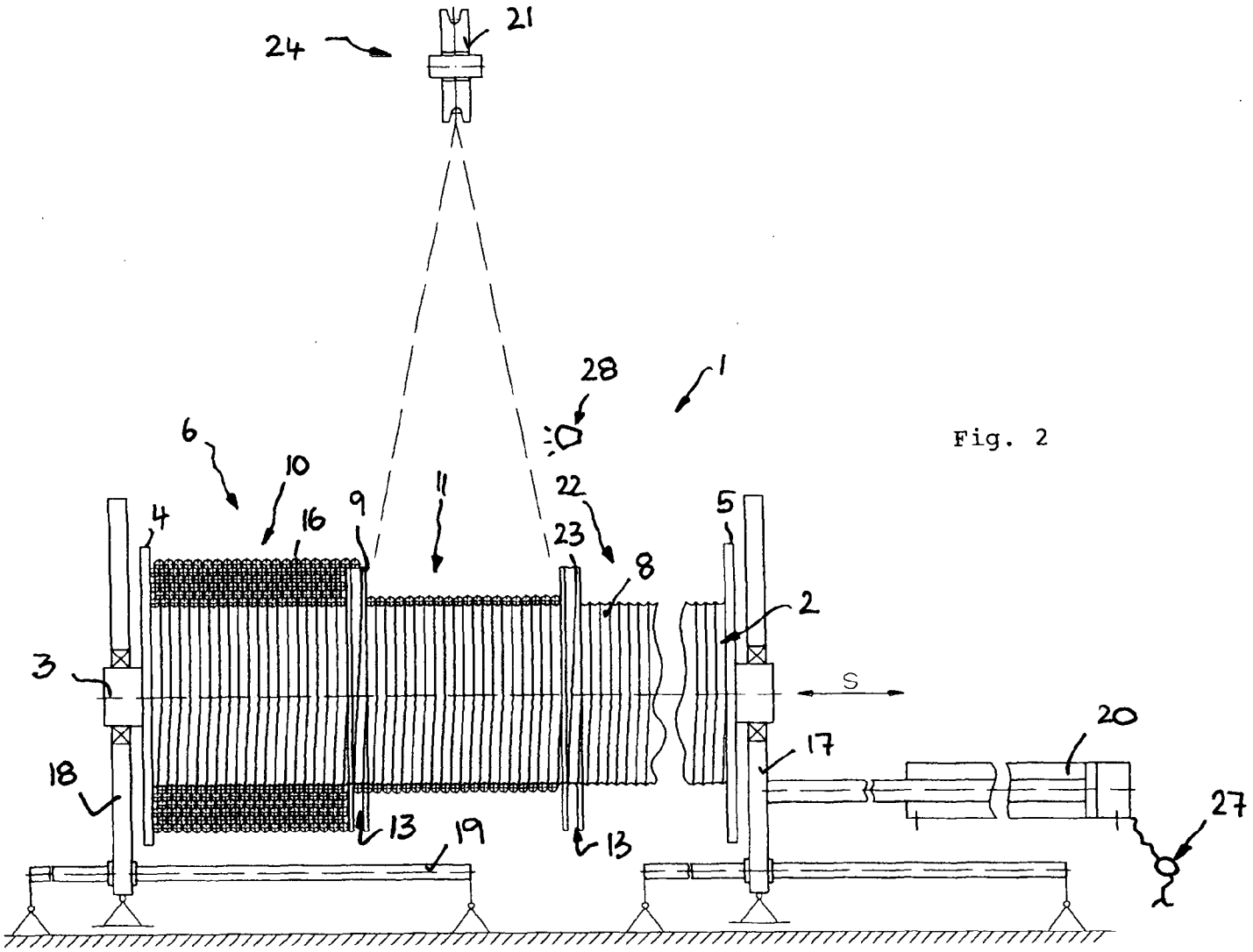
FIG. 2: a plan view of the hoisting winch of a hoisting gear in accordance with a further advantageous embodiment of the invention, in accordance with which the hoisting drum is divided into three part winding regions, with the winding of a middle part winding region being shown and the hoisting drum being configured as longitudinally displaceable via a slide.

As FIGS. 1 and 2 show, a cable guide channel 13 is provided at and over the flanged wheel 9 as a cable guide apparatus 12 and is substantially worked into the jacket surface of the flanged wheel 9 in the form of depressions or grooves. The named cable guide channel 13 in this respect has ends or openings running out toward both part winding regions 10 and 11, i.e. toward both sides of the flanged wheel 9, so that it leads from the first part winding region 10 to the second part winding region 11.

The cable guide channel 13 is in this respect formed spirally overall. Its run-in 14 facing the first part winding region 10 is in this respect approximately at the height of the topmost winding layer, i.e. the cable 16 only runs into the run-in 14 when winding onto the flanged wheel 9 when the first part winding region 10 is completely wound and the cable runs onto the flanged wheel 9 in the topmost winding position. On a division of the winding region 6 into only two part winding regions, the first wound part winding region 10 is that in which the abutment point of the cable 16 is provided at the hoisting drum 2.

If the cable 16 runs into the run-in 14 after a complete winding of the first part winding region 10, it is automatically guided onto the other side of the flanged wheel 9 by the cable guide channel 13 on a further winding up. The run-out 15 of the cable guide channel 13 there opens in this respect into the second part winding region 11 approximately at the height of the jacket surface of the hoisting drum 2, i.e. the cable 16 gently runs onto the hoisting drum 2 directly at the height of the very first winding layer directly on the hoisting drum 2. The pitch of the cable guide channel 13 in the radial direction thus gently overcomes the height difference between the topmost winding position of the first part wincing region 10 and the bottommost, i.e. first, winding layer in the part winding region 11.

On the further winding up onto the hoisting drum 2, the second part winding region 11 is then wound until it is full and the cable is completely wound up. When unwinding the cable 16, the second part winding region 11 conversely first empties until, on the further unwinding, the cable 16 is unwound out of the cable guide channel 13 and in this respect the running-out end is guided beyond the flanged wheel 9 into the first part winding region 10 so that said first part winding region can be unwound.

As FIG. 1 shows, the hoisting drum 2 can be moved in the axial direction, i.e. approximately parallel to the axis of rotation 3 of the drum or to the longitudinal direction of the drum. The lateral bearing plates at which the drive stubs 7 of the hoisting drum 2 are supported form bearing slides 17 and 18 which are longitudinally displaceably supported at a slide guide 19, for example in the form of a T rail section. As FIG. 1 shows, the two bearing slides 17 and 18 can advantageously be longitudinally displaceably displaced independently of one another, with them only being held by the hoisting drum 2 relative to one another in the axial direction. Strains in the named bearing plates or bearing slides 17 and 18 can hereby be avoided.

To be able to control the longitudinal displacement of the hoisting drum 2, an adjustment drive 20 can be connected to one of the bearing slides 17; it can be configured, for example, as a pressure medium cylinder 27 in accordance with the drawn embodiment and displaces one of the bearing slides 17 in the axial direction S. The hoisting drum support is accordingly configured in the manner of a movable-fixed bearing, with the fixed bearing being axially adjustable by the named actuating drive.

The displacement of the hoisting drum 2 in the axial direction can generally be controlled differently, with the control at least having the property in an advantageous further development of the invention that the deflection angle $\alpha$ of the cable 18 running off or onto the hoisting drum 2 does not exceed a predefined limit, with advantageously $\leq 1.5°$ being maintained. Depending on the geometrical relationships of the hoisting winch 1, in particular on the spacing of the cable deflection roller 21 from the hoisting drum 2 and on the number of cable grooves 8 of a part winding region 10 or 11, it can be sufficient to set a fixed axial setting of the hoisting rum 2 relative to the cable deflection roller 21 for each part winding region 10 and 11. In an advantageous further development of the invention, however, provision can also be made that a respective plurality of axial positions can be moved to for the winding and unwinding of each part winding region 10 and 11 to keep the deflection angle $\alpha$ of the cable 16 sufficiently small. The axial positions of the hoisting drum 2 relative to the cable deflection roller 21 are in this respect advantageously varied with a respective adjustment range for each part winding region 10 and 11, with the adjustment regions being able to be configured differently, in particular free of overlap with respect to one another.

In accordance with an advantageous further development of the invention, the hoisting drum 2 can also be adjusted continuously or quasi continuously in the sense of incremental steps in dependence on the rotational position of the hoisting drum 2 and on the pitch of the cable grooves 2 to keep the named deflection angle $\alpha$ as small as possible. Alternatively or additionally, the said deflection angle $\alpha$ can itself also be taken into account for the setting of the axial position of the hoisting drum 2. This can be monitored or determined for this purpose by a suitable detection device 82, for example in the form of a limit switch or a different sensor system. The actuating drive 20 can be controlled in dependence on the detected deflection angle $\alpha$ to keep the named deflection angle $\alpha$ within a predetermined range or at a desired value.

If the flanged wheel 9 bounding the part winding region 10 is moved over by the cable 16 after the winding of this part winding region 10, the speed of rotation of the hoisting drum 2 can advantageously be reduced for this purpose to minimize the wear at the cheeks of the cable guide channel 13. Alternatively or additionally, the hoisting drum 2 can be moved into an axial position in which the named deflection angle $\alpha$ becomes minimal or moves toward zero so that the cable runs into the cable guide channel 13 in the flanged wheel 9 in an exactly straight manner, as FIG. 1 illustrates.

As FIG. 2 illustrates, the hoisting drum 2 can also be divided into more than two part winding regions, with two additional flanged wheels, 9 and 23, for example, being able to be arranged between the lateral flanged wheels 4 and 5 at the end sides in accordance with the embodiment in accordance with FIG. 2 to divide the winding region 6 into three part winding regions 10, 11 and 22. In principle, any number of part winding regions can be provided to be able to store, at least in theory, an infinitely long cable and nevertheless to observe the desired winding parameters, in particular limited number of windings, limited number of lengths and limited deflection angles. In accordance with an advantageous further development of the invention, the hoisting drum 2 is divided into a plurality of part winding regions such that fewer than 40 windings are wound next to one another and fewer than eight layers over one another in one part winding region, with the axial adjustment of the hoisting drum 2 and/or of the cable run-in guide 24 being guided such that the maximum deflection angle $\alpha$ does not exceed 1.5°.

Figure 3:
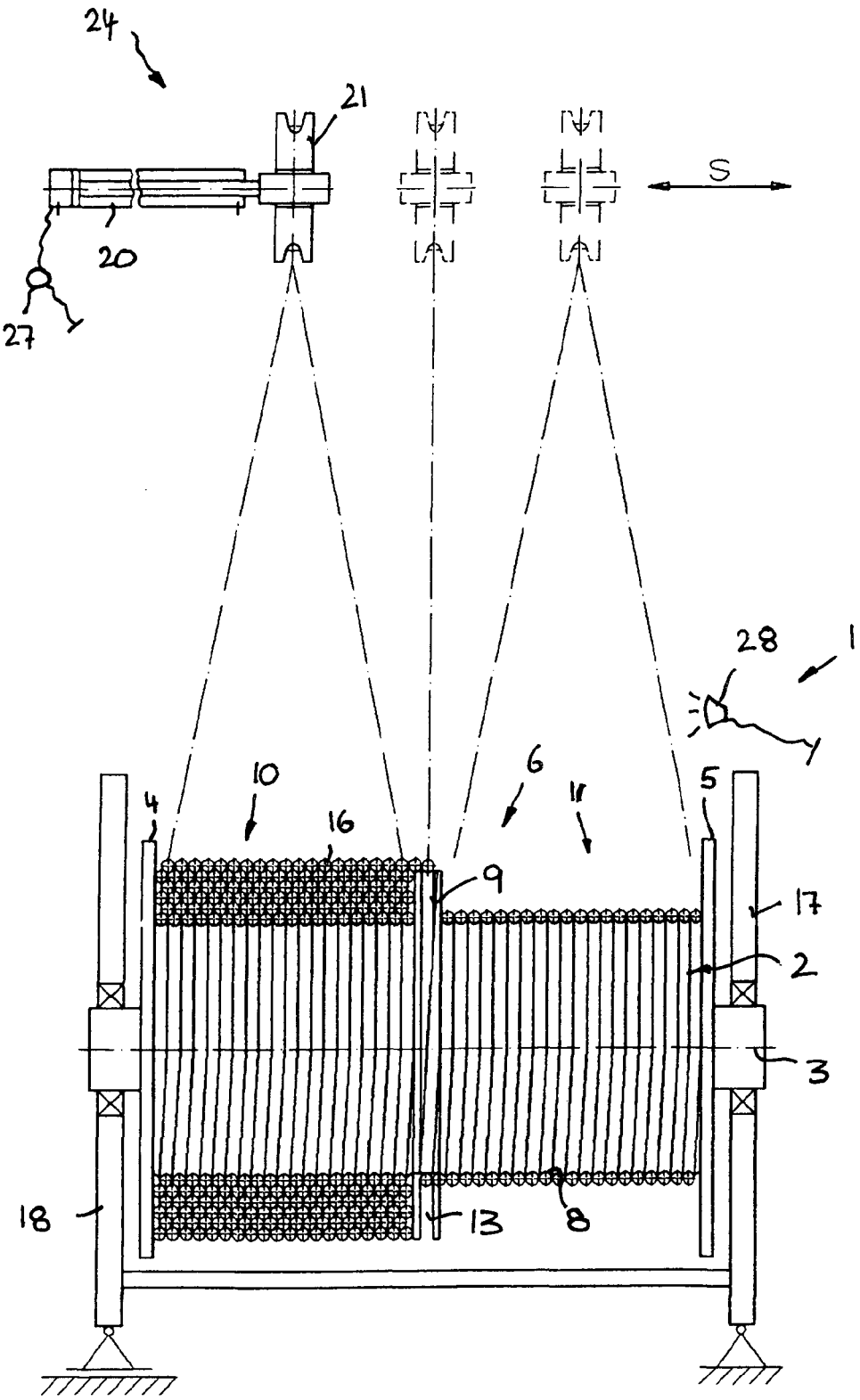
FIG. 3: a plan view of the hoisting winch of a hoisting gear similar to FIG. 1 in accordance with a further advantageous embodiment of the invention, in accordance with which the one cable deflection roller is configured as axially displaceable, with the cable deflection roller being shown in different positions for the winding of different part winding regions.

As FIG. 3 shows, additionally or alternatively to the axial adjustment of the hoisting drum 2, the cable run-in guide 24 can also be adjusted axially approximately parallel to the axis of rotation 3 of the drum. The cable run-in guide 24 can in this respect comprise a cable deflection roller 21 which can be moved axially displaceably in the longitudinal direction S in the named manner, wherein an actuating drive 20, for example in the form of a pressure medium cylinder 27, can provide a displacement of the cable deflection roller. A control of the axial adjustment and the winding of the hoisting drum 2 can in another respect take place analog to the previously described embodiment so that reference can be made hereto.

Figure 4:
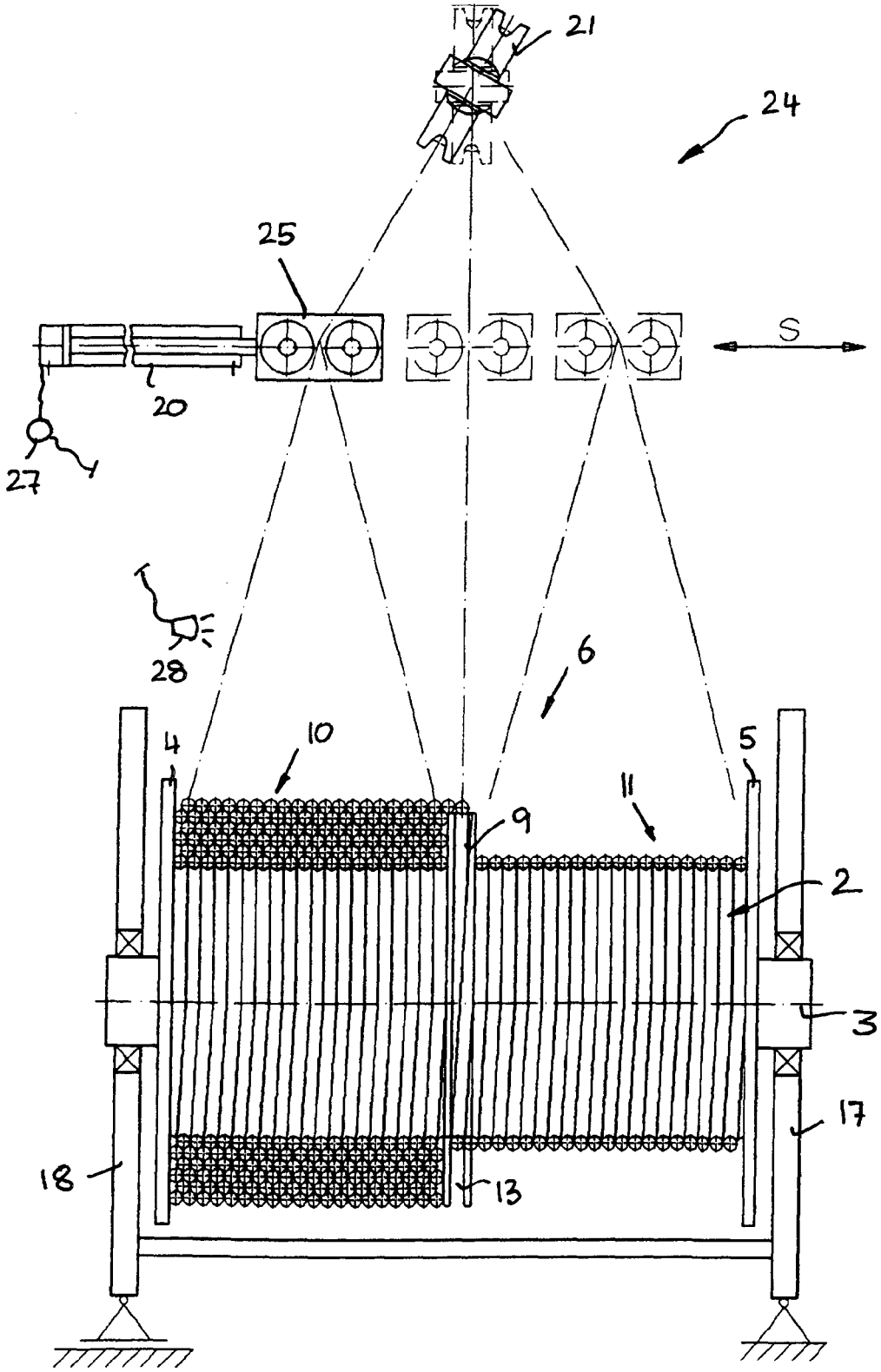
FIG. 4 a plan view of the hoisting winch of a hoisting gear in accordance with a further advantageous embodiment of the invention, in accordance with which the cable run-in guide comprises axially adjustable transverse cable guide means arranged between the hoisting drum and the cable deflection roller, with the named transverse cable guide means being shown in different positions for the winding of different part winding regions of the hoisting drum.

As FIG. 4 shows, the transverse displaceability of the cable run-in guide 24 can also be effected by transverse cable guide means 25 which are arranged between the cable deflection roller 21 and the hoisting drum 2 and can transversely guide the cable 16. The named transverse cable guide means 25 can, for example, comprise two deflection rollers between which the cable 16 runs off. As FIG. 4 shows, the transverse cable guide means 25 can be displaced axially approximately parallel to the axis of rotation 3 of the drum, with an actuating drive 20 being connected to the named transverse cable guide means 25 and being able to be formed by a pressure means cylinder, for example.

So that the cable deflection roller 21 can be aligned independently and can adapt to the respective axial position of the transverse cable guide means 25, the named cable deflection roller 21 can advantageously be pivotably supported, for example in a gimbaled manner, so that the alignment of the pivot axis can vary, cf. FIG. 4, depending on which axial position the transverse cable means 25 adopt.

Figure 5:
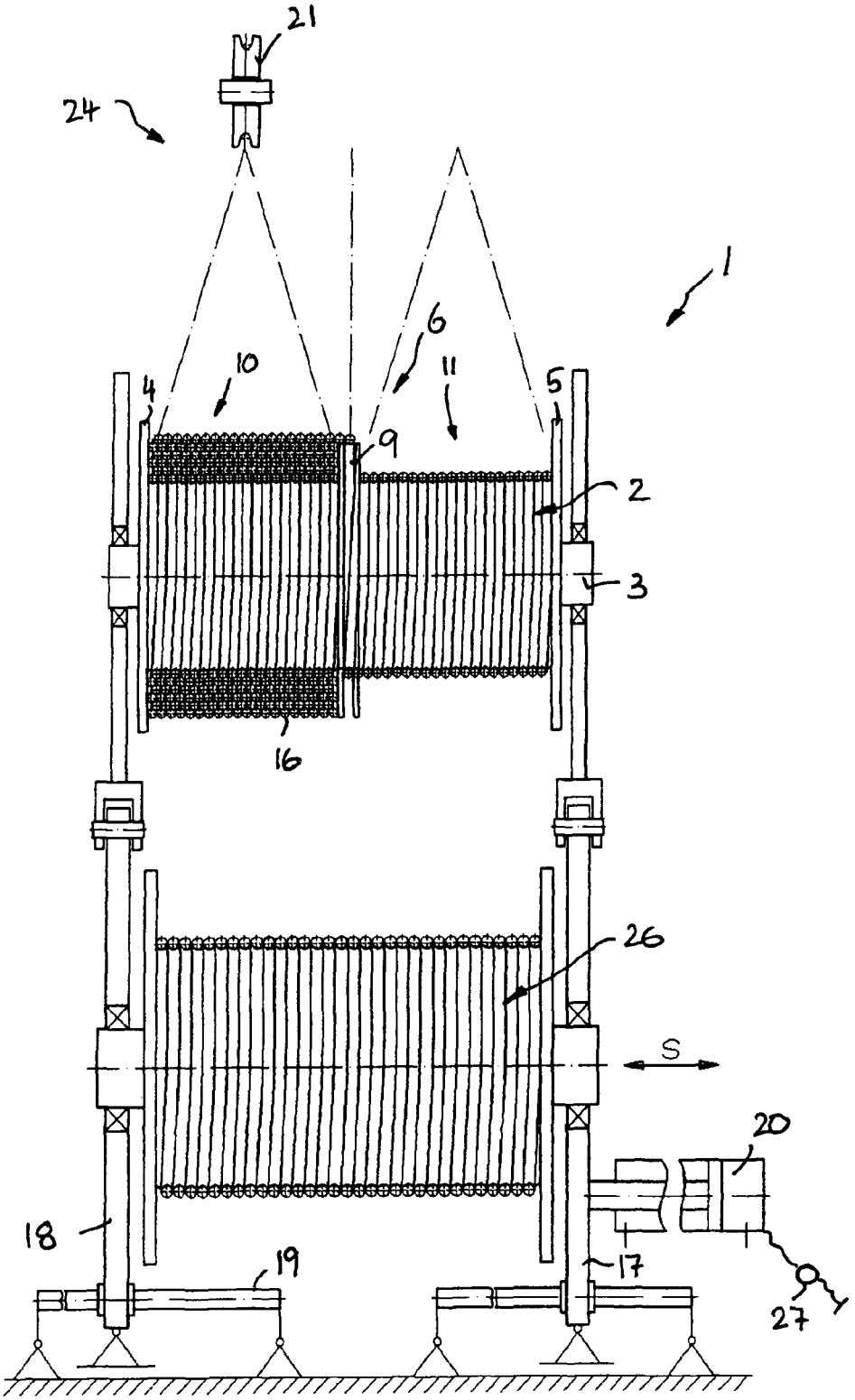
FIG. 5: a plan view of the hoisting winch of a hoisting gear in accordance with a further advantageous embodiment of the invention, in accordance with which the hoisting winch comprises two hoisting drums which can be used as a main winch and as an auxiliary winch and which are adjustable together axially in the longitudinal direction of the drum.

As FIG. 5 shows, the hoisting winch arrangement can also comprise two hoisting drums 2 and 26 of which a first hoisting drum 2 can be divided in the previously described manner into a plurality of part winding regions 10 and 11. The second hoisting drum 26 can likewise be divided in a corresponding manner into a plurality of part winding regions, but can as FIG. 5 shows, also comprise only one winding region 6 in an advantageous further development of the invention. The one of the two hoisting drums 2 and 26 can be used as a main winch and the other as an auxiliary winch. In an advantageous further development of the invention, the hoisting drum 2 can in this respect be placed onto the hoisting drum 26 and/or a common, displaceable bearing can be provided for the two hoisting drums 2 and 26 so that the two hoisting drums 2 and 26 can be displaced together in the axial direction, i.e. substantially parallel to the axis of rotation 3 of the hoisting drum. Corresponding to the previously described embodiments, an actuating drive 20 can also be provided here which can, for example, be connected to one of the bearing slides 17 of the winch arrangement.

Figure 6:
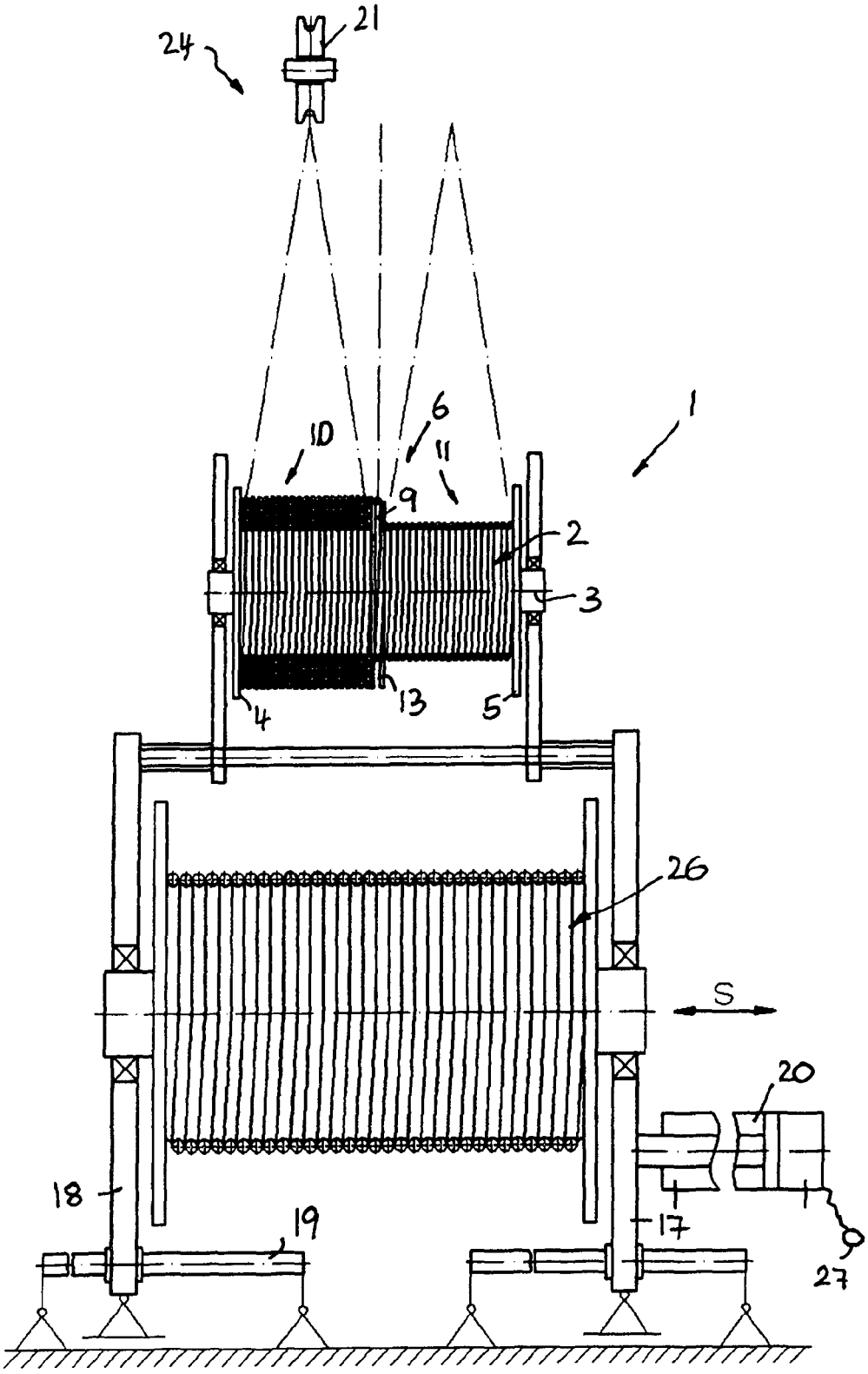
FIG. 6: a plan view of the hoisting winch of a hoisting gear in accordance with a further advantageous embodiment of the invention, in accordance with which the hoisting winch comprises two hoisting drums which can be used as a main winch and as an auxiliary winch and which are adjustable together and relative to one another axially in the longitudinal direction of the drum.

As FIG. 6 shows, the two hoisting drums 2 and 26 can in this respect also have different drum lengths or widths. For example, the hoisting drum 26 only having one winding region can be wider than the hoisting drum 2 divided into different part winding regions.

To be able to use both hoisting drums 2 and 26 simultaneously, provision can be made in an advantageous further development of the invention that in addition to the axial displaceability of the hoisting drums 2 and 26 by the slide bearing and the actuating drive 20, an axial displaceability of the cable run-in guide 24 is also additionally provided which can be formed in accordance with the embodiment in accordance with FIGS. 3 and 4 and can have an axially displaceable cable deflection roller 21 and/or additional transverse cable guide means 25 which are axially adjustable. A cable run-in having the desired small deflection angles $\alpha$ can be realized for both hoisting drums by such a so-to-say double axial displaceability by a displacement in opposite directions and the transition from one part winding region into the other part winding region can take place in a controlled manner.

Furthermore, in a further development of the invention, an axial displacement of the cable drums 2 and 26 can also be provided relative to one another.

Figure 7A:
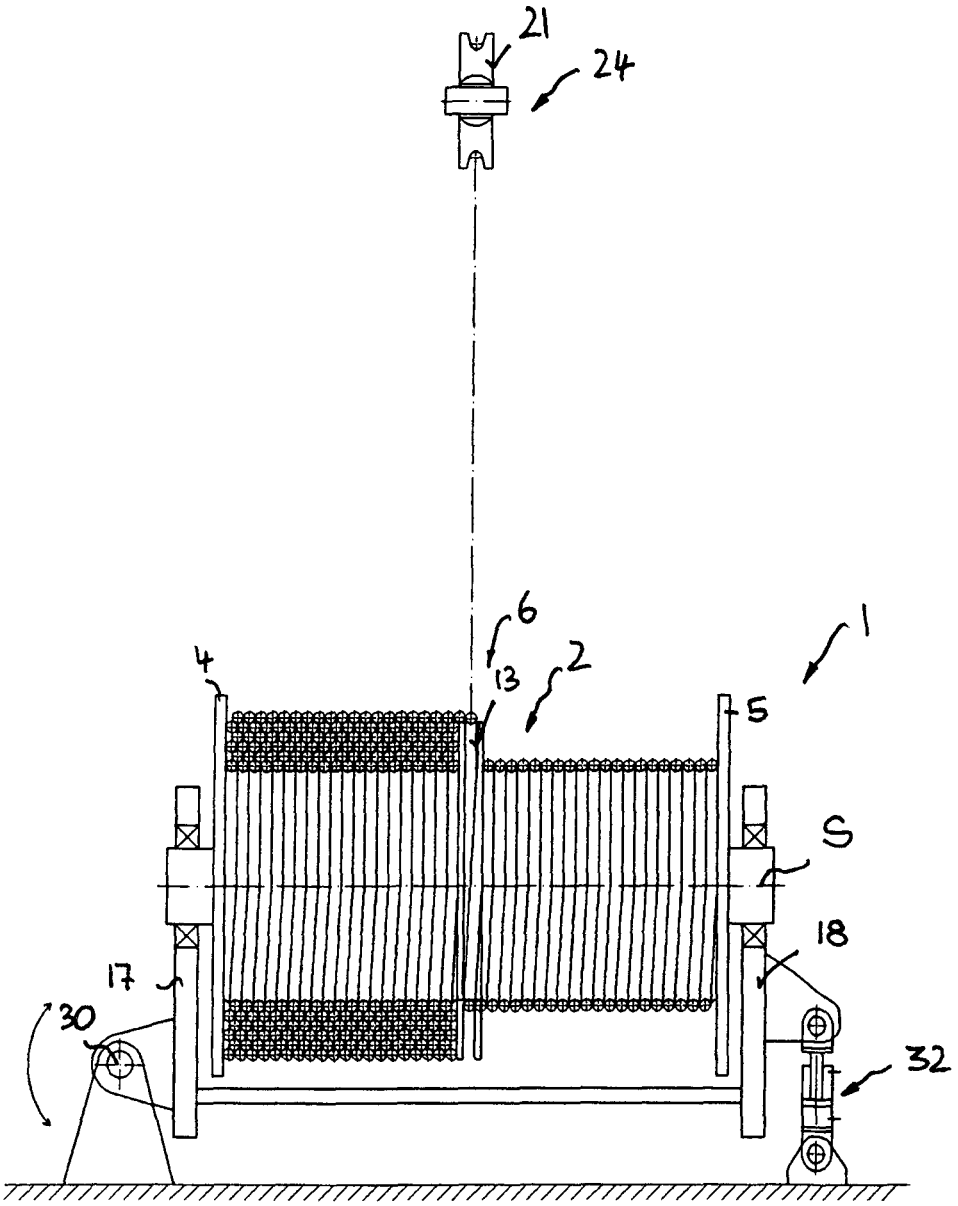
FIG. 7: a plan view of a hoisting winch of a hoisting gear in accordance with a further advantageous embodiment of the invention, in accordance with which the hoisting drum is divided into a plurality of part winding regions and can be tilted about a tilt axis transversely to the longitudinal direction of the drum, with the two views FIG. 7*a* and FIG. 7*b* showing different tilt positions of the hoisting drum.
Figure 7B:
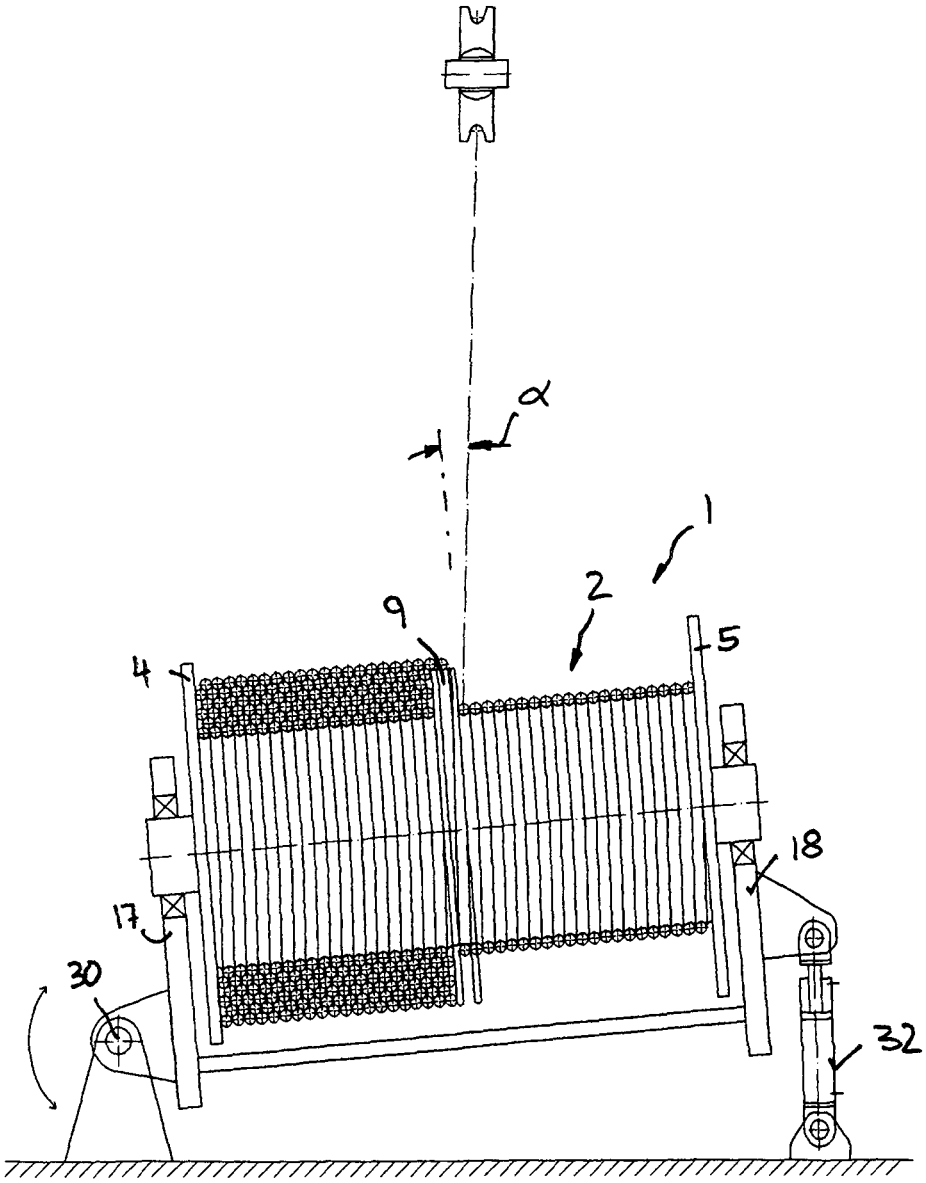

As FIG. 7 shows, the aforesaid deflection angle $\alpha$ of the cable 16 running off the hoisting drum 2 or running in to it can also be kept small despite a plurality of part winding regions in that the hoisting drum 2 can be tilted about a tilt axis. The named tilt axis 30 in this respect extends transversely to the longitudinal direction S of the drum and advantageously at least approximately perpendicular to the run-in direction of the cable 16 so that a drift of the cable with respect to the hoisting drum can be eliminated or minimized by tilting the hoisting drum. As FIG. 7 shows, the named tilt axis 30 can in this respect extend approximately parallel to the fastening plane of the hoisting winch 1. The adjustability of the angles from the direction of the hoisting drum 2 can in this respect be achieved by a corresponding support of the lateral bearing plates 17 and 18. As FIG. 7 shows, a bearing plate 17 can be supported tiltably about the said tilt axis 30, while the oppositely disposed bearing plate 18 is adjustable by an actuating drive 32, for example in the form of a servo control cylinder, such that the hoisting winch 1 can tilt about the tilt winch 1, as a comparison of FIGS. 7*a* and 7*b* shows.

Figure 8:
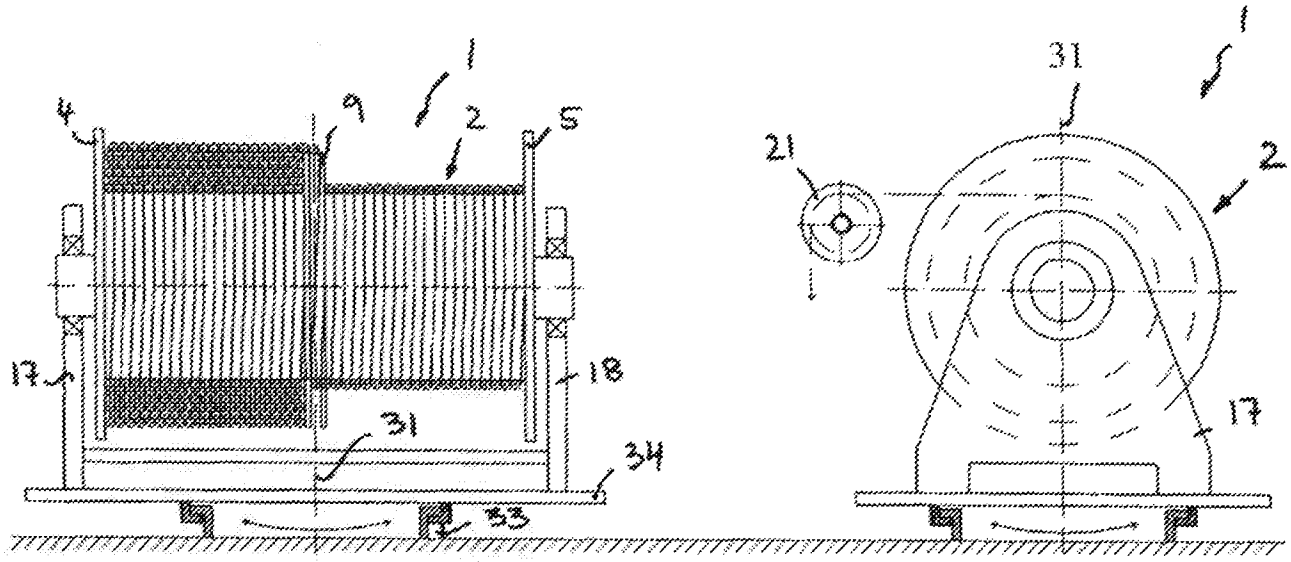
FIG. 8: a representation of a hoisting winch of a hoisting gear in accordance with a further advantageous embodiment of the invention, in accordance with which the hoisting drum is divided into a plurality of part winding regions and is pivotable about a pivot axis perpendicular to the longitudinal direction of the drum, with the part view FIG. 8*a* showing a plan view of the hoisting drum and the part view FIG. 8*b* showing a side view of the hoisting drum.

As FIG. 8 shows, the hoisting drum 2 can also be configured as pivotable about a pivot axis 31, with here the named pivot axis 31 being orientated substantially perpendicular to the longitudinal axis of the drum and being able to extend in the region of the center of the hoisting drum such that on the pivoting of the hoisting drum 2 its ends carry out movements in an equal measure. The named pivot axis 31 in this respect advantageously likewise extends at least approximately perpendicular to the run-in direction of the cable 16, cf. FIG. 8*b*.

The pivotability of the hoisting drum 2 can, as FIG. 8 shows, be achieved by a corresponding pivotable suspension of the lateral bearing plates 17 and 18. The named bearing plates 17 and 18 can be fastened to a base carrier 34 which is pivotably supported about the named pivot axis. The base carrier 34 and thus the hoisting drum 2 can be pivoted in the desired manner by a corresponding pivot drive 33.

Figure 9:
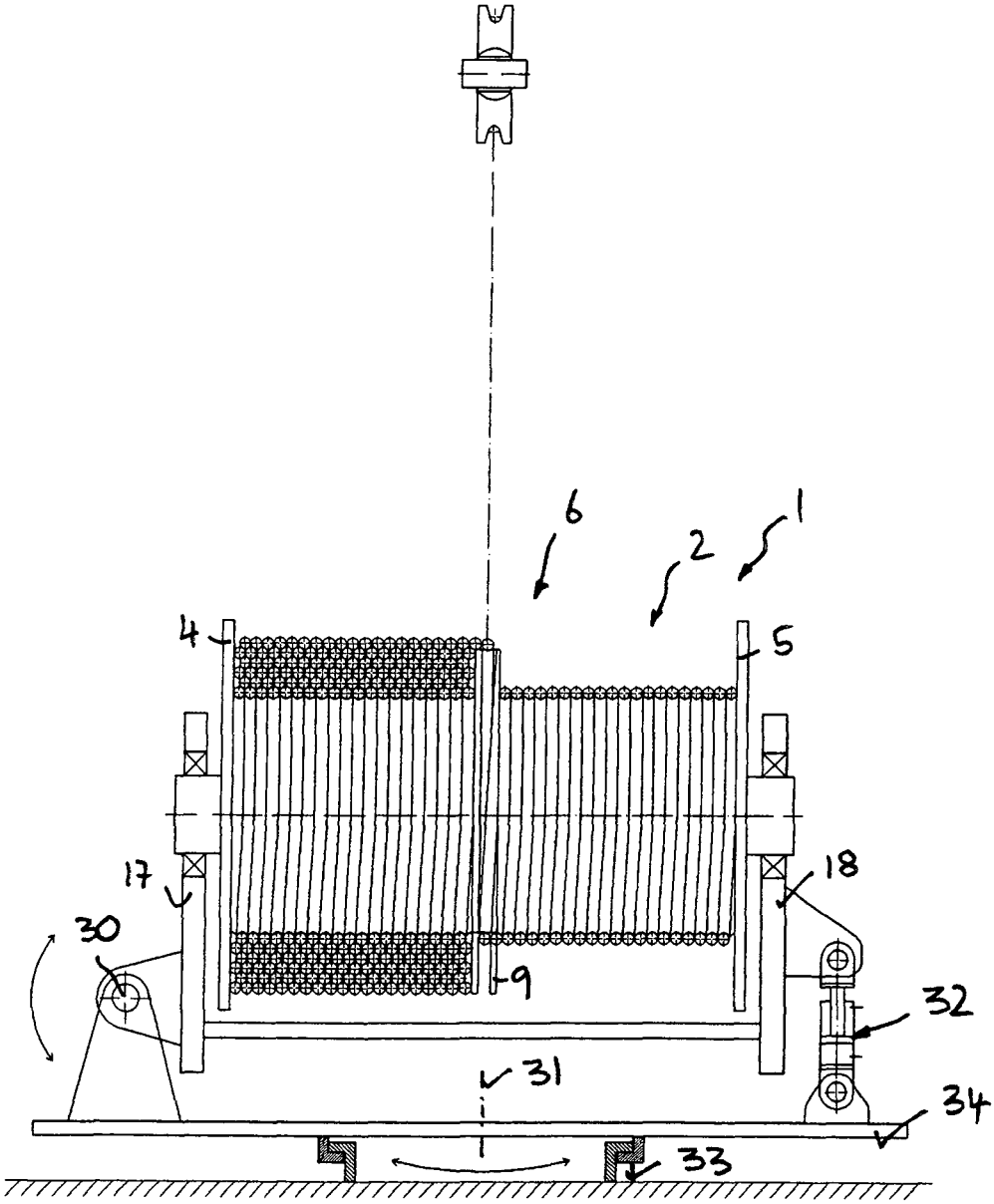
FIG. 9: a plan view of a hoisting winch of a hoisting gear in accordance with a further advantageous embodiment of the invention, in accordance with which the hoisting winch is divided into two or more part winding regions and its angular alignment is biaxially adjustable, and indeed tiltable about a tilt axis and pivotable about a pivot axis, with the tilt axis and the pivot axis extending in directions orientated perpendicular to one another.

As FIG. 9 shows, the tiltability of the embodiment in accordance with FIG. 7 and the pivotability of the embodiment in accordance with FIG. 8 can also be combined with one another, in particular such that the tilt axis 30 and the pivot axis 33 are orientated in directions extending transversely to one another. Such a biaxial angular adjustability of the hoisting drum 2 is in particular of advantage when the cable run-in into the hoisting winch 1 is variable, i.e. the running in/running off cable 16 is pivoted about the longitudinal axis of the drum or about an axis parallel thereto so that the cable run-in point/cable run-off point migrates in the peripheral direction. This is, for example, frequently the case with cranes which have a luffable boom at which the run-in roller is fastened so that the cable run-in direction pivots in the named manner on the luffing up and down of the crane boom.

As FIG. 9 shows, the bearing plates 17 and 18 of the hoisting drum 2 are, in a similar manner to the embodiment in accordance with FIG. 7, tiltably supported about a tilt axis 30 or are connected to a corresponding tilt drive 32, with the tiltability being provided with respect to a base carrier 34 which is in turn, in a manner similar to the embodiment in accordance with FIG. 8, pivotably supported about the pivot axis 31 and can be actuated by a pivot drive 33.

Figure 10:
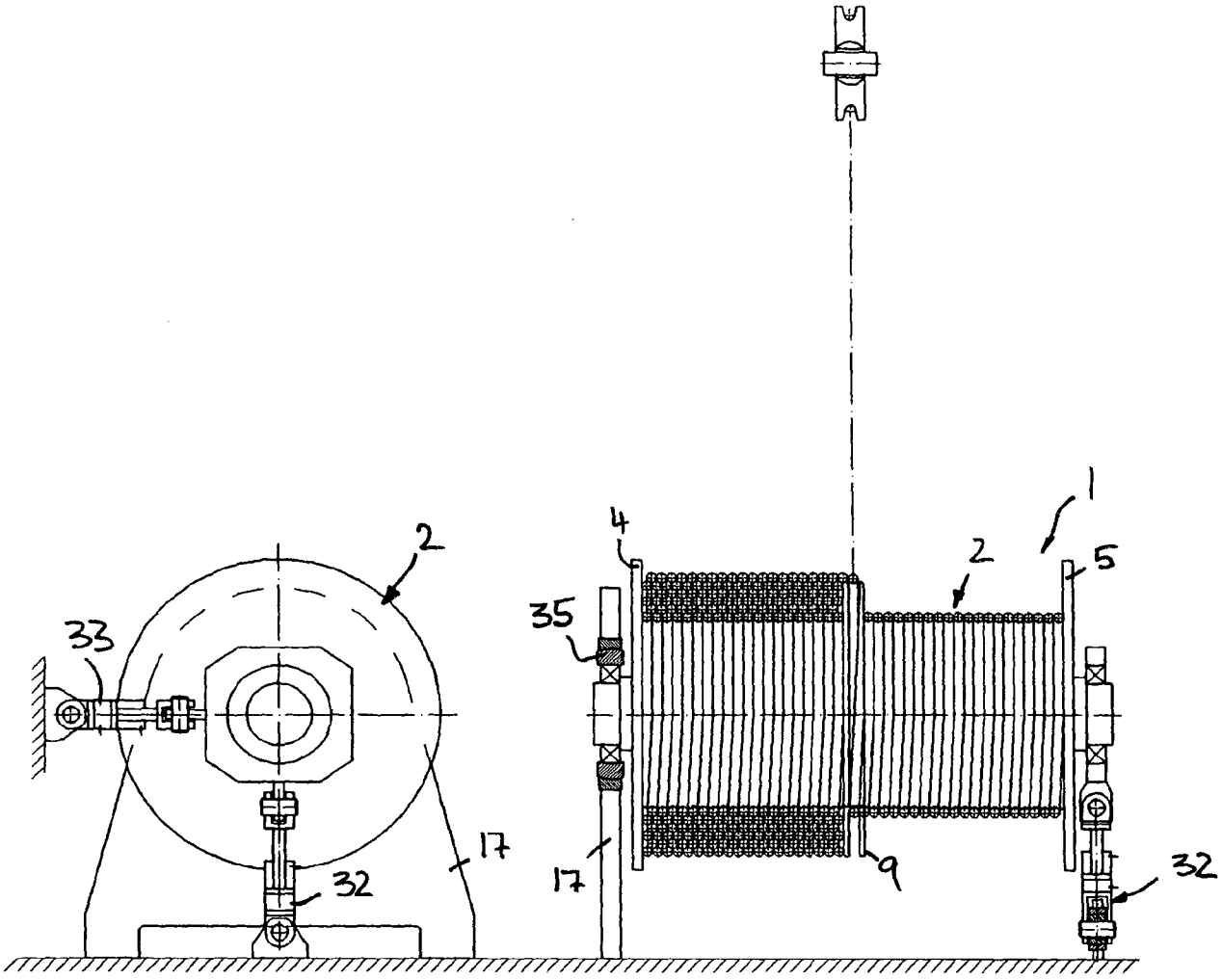
FIG. 10: a representation of a hoisting winch of a hoisting gear in accordance with a further advantageous embodiment of the invention, in accordance with which the hoisting drum is divided into a plurality of part winding regions and its angular division is biaxially adjustable—similar to the embodiment of FIG. 9—namely tiltable about a tilt axis and pivotable about a pivot axis, with—unlike in the embodiment of FIG. 9—the hoisting drum being tiltable and pivotable with respect to a fixed bearing plate and being connected to two adjustment actuators which can be actuated in two angular directions perpendicular to one another, with the part view FIG. 10*a* showing a plan view of the hoisting winch and the part view FIG. 10*b* showing a side view of the hoisting winch.
Figure 11:
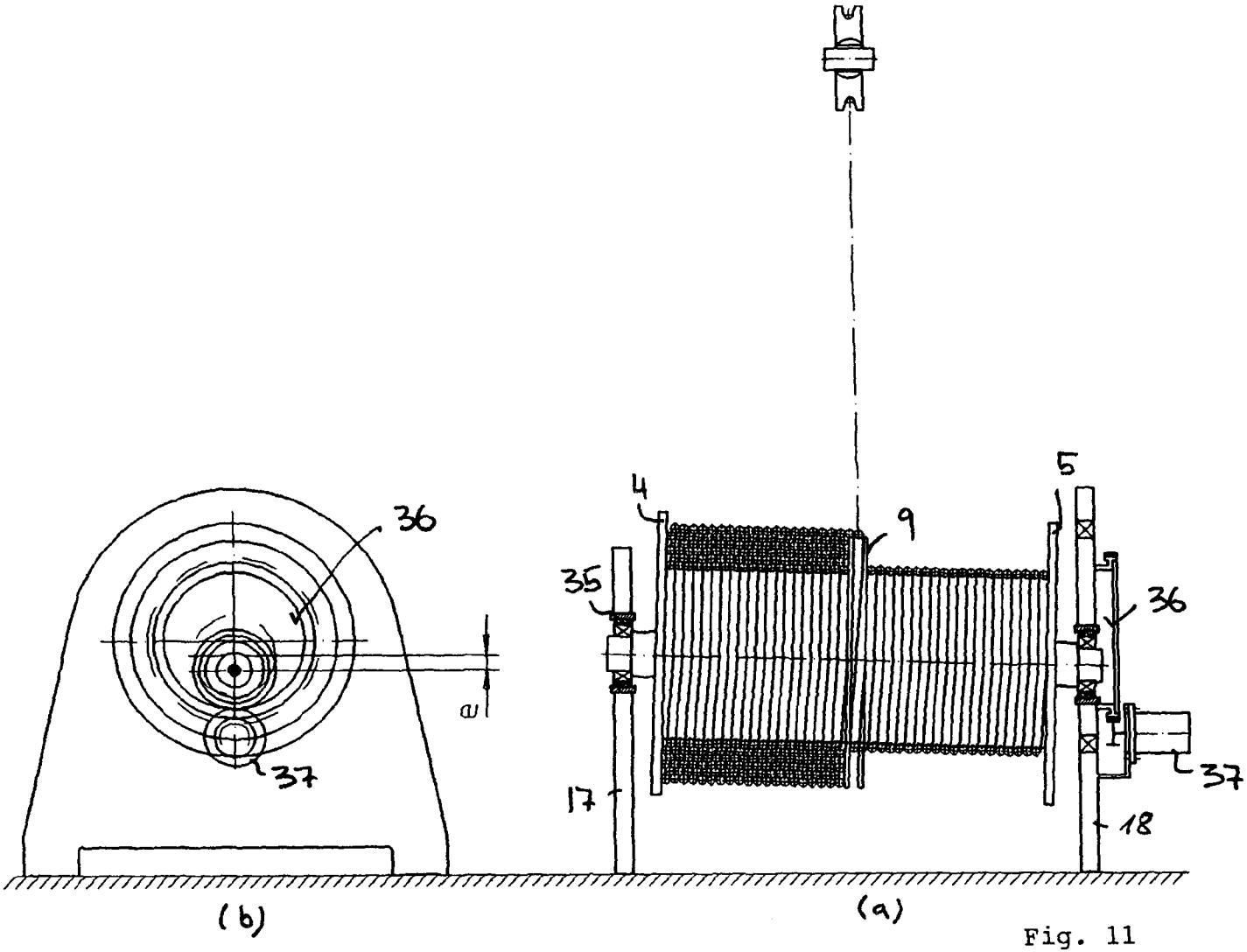
FIG. 11: a representation of a hoisting winch of a hoisting gear in accordance with a further advantageous embodiment of the invention, in accordance with which the hoisting drum is divided into several part winding regions and the angular position of the hoisting drum is biaxially adjustable, with one of the drum ends being supported in an oscillating manner for the angular adjustment of the hoisting drum and with the other one of the drum ends being adjustable by an eccentric tappet transversely to the longitudinal direction of the drum.

Alternatively to such a pivotability of the bearing plates, the angular adjustability of the hoisting drum 2 can also be achieved by a movability of the hoisting drum 2 relative to the bearing plates as FIGS. 10 and 11 show. In accordance with FIG. 10, a rigidly fastened bearing plate 17 can be provided at which the ends of the hoisting drum 2 are supported in a rotatable and oscillating or tiltable manner. This is possible, for example, by a pivot drive pendulum bearing 35 having a spherically arched bearing shell. The hoisting drum is multiaxially tiltable with respect to the named bearing plate 17. To control this multiaxial tiltability, two actuating drives are provided at the oppositely disposed end of the hoisting drum 2 which have effective directions which are essentially perpendicular to one another and which allow the hoisting drum 2 to be displaced at this end in each case perpendicular to the longitudinal direction S of the drum. The one actuating drive in this respect forms a tilt drive 32, while the other actuating drive forms a pivot drive 33 so that the hoisting drum is both tiltable and pivotable about tilt and pivot axes 30 and 31 in the aforesaid manner.

As FIG. 11 shows, an adjustment of the angular alignment of the hoisting drum 2 can also be achieved by an eccentric bearing. In this respect, in a similar manner to the embodiment of FIG. 10, an end of the hoisting drum 2 can be supported in a routable and oscillating or tiltable manner at a bearing plate 17 rigid per se. The oppositely disposed end of the hoisting drum 2 is rotatably supported in an eccentric tappet 36 which is adjustable with respect to a likewise rigidly supported bearing plate 18. The named eccentric tappet 36 can in this respect form a rotatable eccentric disk which is rotatably supported in the named bearing plate 18 about an axis parallel to the longitudinal direction of the drum. The named end of the hoisting drum 2 can be adjusted by rotating the eccentric tappet 36 such that a tilting or pivoting of the hoisting drum 2 is achieved about an axis transverse to the longitudinal direction of the drum. A corresponding actuating drive 37 can be provided to adjust the said eccentric tappet, with an electric motor as an actuating drive, for example, being able to drive the named eccentric tappet via a gear stage.

The tilting and/or pivoting of the hoisting drum 2 can generally be controlled differently, with the control at least having the property in an advantageous further development of the invention that the deflection angle $\alpha$ of the cable 16 running off or running into the hoisting drum 2 does not exceed a predefined limit and is advantageously held $\leq 1.5°$. Depending on the geometrical relationships of the hoisting winch 1, in particular on the spacing of the cable deflection roller 21 from the hoisting drum 2 and on the number of cable grooves 8 of a part winding region 10 or 11, it can be sufficient to set a fixed angular position of the hoisting drum 2 with respect to the tilt axis 30 and/or with respect to the pivot axis 31 for each part winding region 10 and 11. In an advantageous embodiment of the invention, however, provision can also be made that respective different angular positions are traveled to for the winding or unwinding of each part winding region 10 and 11 to keep the deflection angle $\alpha$ of the cable sufficiently small. The tilt or pivot positions of the cable drum 2 are in this respect advantageously varied within a respective adjustment range for each part winding region 10, with the adjustment ranges being configured differently for the different part winding regions and can in particular be overlap-free with respect to one another.

In accordance with an advantageous further development of the invention, the hoisting drum 2 can also be tilted or pivoted continuously or quasi continuously in the sense of incremental steps in dependence on the rotational position of the hoisting drum 2 and on the pitch of the cable grooves 2 to keep the named deflection angle $\alpha$ as small as possible. Alternatively or additionally, the said deflection angle $\alpha$ can itself also be taken into account for the setting of the angular position of the hoisting drum 2. This can be monitored or determined for this purpose by a suitable detection device 28, for example in the form of a limit switch or a different sensor system. The tilt drive 32 and/or the pivot drive 33 can be controlled in dependence on the detected deflection angle $\alpha$ to keep the named deflection angle $\alpha$ within a predetermined range or at a desired value.

If the flanged wheel 9 bounding the part winding region 10 is moved over by the cable 16 after the winding of this part winding region 10, the speed of rotation of the hoisting drum 2 can advantageously be reduced for this purpose to minimize the wear at the cheeks of the cable guide channel 13. Alternatively or additionally, the hoisting drum 2 can be tilted or pivoted such that the named deflection angle $\alpha$ becomes minimal or moves toward zero so that the cable 16 runs into the cable guide channel 13 in the flanged wheel 9 in an exactly straight manner, as FIG. 1 illustrates. The hoisting drum 2 can advantageously also be tilted or pivoted such that the cable runs away from the flanged wheels or end disks.

The named tilt or pivot of the hoisting drum can optionally be combined with the axial displacement of the hoisting drum and/or of the cable deflection roller.

The invention claimed is:

1. A hoisting gear winch, comprising:

a hoisting drum having a winding region bounded by first and second lateral flanged wheels, with at least a third flanged wheel provided between the first and second lateral flanged wheels, thereby dividing the winding region into at least two part winding regions, a cable run-in control apparatus, and a detection device which detects a cable run-in deflection angle, wherein a cable is configured to be guided beyond the third flanged wheel into the at least two part winding regions, wherein the hoisting drum is axially adjustable in the longitudinal direction of the drum, and the cable run-in control apparatus is configured to set at least two axial positions of the hoisting drum for the winding/unwinding of the at least two different part winding regions, respectively, wherein the cable run-in control apparatus axially adjusts the hoisting drum continuously or stepwise depending on the cable run-in deflection angle, wherein the third flanged wheel includes a cable guide channel having a run-in which is an end of the cable guide channel opening to a first winding region of the at least two part winding regions and a run-out which is an end of the cable guide channel opening to a second winding region of the at least two part winding regions, wherein the run-in of the cable guide channel is provided at a height corresponding to a topmost winding layer of a first winding region of the at least two part winding regions and the run-out of the cable guide channel is provided at a height corresponding to a lowermost winding layer of a second winding region of the at least two part winding regions, and wherein the height of the run-in is higher than a circumferential wall portion of the first winding region by more than twice the diameter of the cable.

2. The hoisting gear winch in accordance with claim 1, wherein the hoisting drum is supported at oppositely disposed end sections by respective bearing slides, wherein the bearing slides are displaceably supported substantially parallel to the longitudinal direction of the hoisting drum, and wherein an actuating drive is associated with one of the bearing slides for adjusting the hoisting drum in the longitudinal direction thereof.

3. The hoisting gear winch in accordance with claim 2, wherein the bearing slides are displaceable independently of one another and are only held relative to one another in the axial direction by the hoisting drum.

4. The hoisting gear winch in accordance with claim 1, wherein the hoisting drum is configured to be tiltable, pivotable, or both tiltable and pivotable, about at least one transverse axis which is transverse to the longitudinal direction of the drum, and wherein the cable run-in control apparatus is configured to set at least two tilt/pivot positions of the hoisting drum for the winding/unwinding of the at least two different part winding regions, respectively, and wherein the cable run-in control apparatus adjusts the tilt/pivot positions of the hoisting drum depending on the cable run-in deflection angle.

5. The hoisting gear winch in accordance with claim 4, wherein the hoisting drum is tiltable and pivotable about two different transverse axes which are each transverse to the longitudinal direction of the hoisting drum and which are transverse with respect to each other.

6. The hoisting gear winch in accordance with claim 5, wherein the cable run-in control apparatus controls at least one of the tilt angle and pivot angle of the hoisting drum based on the run-in direction/run-off direction of the cable running into/off the hoisting drum.

7. The hoisting gear winch in accordance with claim 1, wherein the hoisting drum is supported by respective bearing plates at oppositely disposed end sections, and wherein the bearing plates are tiltably adjustable by a tilt drive, are pivotably adjustable by a pivot drive, or are both tiltably adjustable by the tilt drive and pivotably adjustable by the pivot drive.

8. The hoisting gear winch in accordance with claim 1, wherein a first end section of the hoisting drum is rotatably and tiltably supported at a bearing plane, wherein a second end section, disposed on an opposite side of the hoisting drum relative to the first end section, is coupled to at least one of a tilt drive, pivot drive or eccentric tappet, and wherein the second end section is adjustable relative to the first end section of the hoisting drum transversely to the longitudinal direction of the drum by actuating the at least one of the tilt drive, pivot drive or eccentric tappet.

9. The hoisting gear winch in accordance with claim 1, wherein a cable run-in guide is provided for guiding run-in/run-off of the cable, wherein the cable run-in guide is adjustable axially in the longitudinal direction of the hoisting drum relative to the hoisting drum, and wherein the cable run-in control apparatus is configured to set at least two axial positions of the cable run-in guide for the winding/unwinding of the at least two different part winding regions, respectively.

10. The hoisting gear winch in accordance with claim 9, wherein the cable run-in guide comprises an axially adjustable cable deflection roller and an actuating drive associated with the axially adjustable cable deflection roller.

11. The hoisting gear winch in accordance with claim 9, wherein the cable run-in guide comprises axially adjustable cable guide means arranged between the hoisting drum and the cable deflection roller, wherein the cable deflection roller is supported in at least one of an oscillating manner and a pivotable manner, and wherein the cable deflection roller aligns itself with respect to the transverse cable guide means in accordance with the axial position of the transverse cable guide means.

12. The hoisting gear winch in accordance with claim 9, wherein the cable run-in control apparatus is configured to hold at least one of the hoisting drum and the cable run-in guide at a first part winding region in a first axial adjustment region or at a second part winding region in a second axial adjustment region, and wherein the first and second axial adjustment regions do not overlap.

13. The hoisting gear winch in accordance with claim 9, wherein the cable run-in control apparatus is configured to hold at least one of the hoisting drum and the cable run-in guide at an axial position of the third flanged wheel, such that the cable runs substantially deflection-free onto the third flanged wheel.

14. The hoisting gear winch in accordance with claim 9, wherein the cable run-in control apparatus axially adjusts at least one of the hoisting drum and the cable run-in guide continuously or stepwise depending on at least one of revolution of the hoisting drum, a rotational position of the hoisting drum, a rotational speed of the hoisting drum, and a winch pitch.

15. The hoisting gear winch in accordance with claim 9, wherein the cable run-in control apparatus axially adjusts the cable run-in guide continuously or stepwise depending on the cable run-in deflection angle.

16. The hoisting gear winch in accordance with claim 9, wherein the cable run-in control apparatus provides only one axial position of at least one of the hoisting drum and the cable run-in guide for each part winding region.

17. The hoisting gear winch in accordance with claim 1, wherein the rotational speed of the hoisting drum is reduced by a control apparatus when the cable moves beyond the third flanged wheel.

18. The hoisting gear winch in accordance with claim 1, further comprising a second hoisting drum, the second hoisting drum being axially displaceably supported together with the first hoisting drum.

19. The hoisting gear winch in accordance with claim 1, wherein a second hoisting drum and the first hoisting drum are axially adjustable relative to one another, and wherein an axial position of the second hoisting drum always overlaps with an axial position of the first hoisting drum.

20. A hoisting gear winch, comprising:

a hoisting drum having a winding region bounded by first and second lateral flanged wheels, with at least a third flanged wheel provided between the first and second lateral flanged wheels, thereby dividing the winding region into at least two part winding regions, a cable run-in control apparatus, and a detection device which detects a cable run-in deflection angle, wherein a cable is configured to be guided beyond the third flanged wheel into the at least two part winding regions, wherein the hoisting drum is axially adjustable in the longitudinal direction of the drum, and the cable run-in control apparatus is configured to set at least two axial positions of the hoisting drum for the winding/unwinding of the at least two different part winding regions, respectively, wherein the cable run-in control apparatus axially adjusts the hoisting drum continuously or stepwise depending on the cable run-in deflection angle, wherein the cable run-in control apparatus is configured to control the axial displacement of the hoisting drum such that, in each of the at least two different part winding regions, the cable is separately wound into a plurality of cable layers, wherein the cable run-in control apparatus is configured to control the axial displacement of the hoisting drum such that, in each of the at least two different part winding regions, the hoisting drum is positioned at a plurality of axial positions, wherein the third flanged wheel includes a cable guide channel having a run-in which is an end of the cable guide channel opening to a first winding region of the at least two part winding regions and a run-out which is an end of the cable guide channel opening to a second winding region of the at least two part winding regions, and wherein the run-in of the cable guide channel is provided at a height corresponding to a topmost winding layer of a first winding region of the at least two part winding regions and the run-out of the cable guide channel is provided at a height corresponding to a lowermost winding layer of a second winding region of the at least two part winding regions.

21. A hoisting gear winch, comprising:

a hoisting drum having a winding region bounded by first and second lateral flanged wheels, with at least a third flanged wheel provided between the first and second lateral flanged wheels, thereby dividing the winding region into at least two part winding regions, a cable run-in control apparatus, and a detection device which detects a cable run-in deflection angle, wherein a cable is configured to be guided beyond the third flanged wheel into the at least two part winding regions, wherein the hoisting drum is axially adjustable in the longitudinal direction of the drum, and the cable run-in control apparatus is configured to set at least two axial positions of the hoisting drum for the winding/unwinding of the at least two different part winding regions, respectively, wherein the cable run-in control apparatus axially adjusts the hoisting drum continuously or stepwise depending on the cable run-in deflection angle, wherein the cable run-in control apparatus is configured to control the axial displacement of the hoisting drum such that, in each of the at least two different part winding regions, the cable is separately wound into a plurality of cable layers, wherein the cable run-in control apparatus is configured to control the axial displacement of the hoisting drum such that, in each of the at least two different part winding regions, the hoisting drum is positioned at a plurality of axial positions, wherein the third flanged wheel includes a cable guide channel having a run-in which is an end of the cable guide channel opening to a first winding region of the at least two part winding regions and a run-out which is an end of the cable guide channel opening to a second winding region of the at least two part winding regions, wherein the run-in of the cable guide channel is provided at a height corresponding to a topmost winding layer of the first winding region of the at least two part winding regions and the run-out of the cable guide channel is provided at a height corresponding to a lowermost winding layer of the second winding region of the at least two part winding regions, and wherein the cable run-in control apparatus is configured to control the axial displacement of the hoisting drum such that a plurality of layers are wound in the first winding region of the at least two part winding regions before the cable is guided into the cable guide channel of the third flanged wheel and thereafter, the cable is wound in a plurality of layers in the second winding region of the at least two part winding regions.

* * * * *